US006393865B1

(12) United States Patent
Coakley et al.

(10) Patent No.: US 6,393,865 B1
(45) Date of Patent: May 28, 2002

(54) COMBINED SERVICE MAIN AIR/PRODUCT COMPRESSOR

(75) Inventors: Vincent Coakley, Annandale, NJ (US); Joseph Gerard Wehrman, Macungie; Bruce Kyle Dawson, Bethlehem, both of PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/671,073

(22) Filed: Sep. 27, 2000

(51) Int. Cl.[7] ..... F25J 3/00
(52) U.S. Cl. ..... 62/643; 62/653; 62/652
(58) Field of Search ..... 62/643, 646, 653, 62/644, 648, 652

(56) References Cited

U.S. PATENT DOCUMENTS

| | | | | | |
|---|---|---|---|---|---|
| 5,402,631 | A | * | 4/1995 | Wulf | 60/39.02 |
| 5,485,719 | A | * | 1/1996 | Wulf | 60/39.07 |
| 5,758,515 | A | * | 6/1998 | Howard | 62/646 |
| 5,901,579 | A | * | 5/1999 | Mahoney et al. | 62/643 |
| 5,924,307 | A | * | 7/1999 | Nenov | 62/643 |

FOREIGN PATENT DOCUMENTS

| | | | | |
|---|---|---|---|---|
| EP | 0672877 | * | 9/1995 | F25J/3/04 |

OTHER PUBLICATIONS

Air Products and Chemicals, Inc. Research disclosure 40380, entitled "Integrated Air Booster and Oxygen Compression for Partial Pumped LOX cryogenic Air Separation Process Cycle", published Nov. 1997.*

Air Products and Chemicals, Inc. Research Disclosure 41763, entitled "Oxygen Enrichment of Air: Process Developments and Economic Trends ", published Jan. 1999.*

* cited by examiner

*Primary Examiner*—William C. Doerrler
(74) *Attorney, Agent, or Firm*—Willard Jones, II

(57) ABSTRACT

A combined main air/$O_2$ enriched product compressor for use with an air separation unit that produces $O_2$ enriched product is provided that includes a prime mover that drives a bull gear. The bull gear drives at least two pinion gears, and the pinion gears drive several compression stages where at least one compression stage compresses feed air for the air separation unit and at least one compressor stage compresses $O_2$ enriched product from the air separation unit. The combined main air/$O_2$ enriched product compressor satisfies all air separation unit feed air requirements and at least some compression for the oxygen product from the air separation unit. A method is also provided.

12 Claims, 2 Drawing Sheets

COMBINED SERVICE MAIN AIR/PRODUCT COMPRESSOR

CROSS REFERENCES TO RELATED APPLICATIONS

Not applicable

STATEMENT REGARDING FEDERALLY SPONSORED RESEARCH OR DEVELOPMENT

Not applicable

BACKGROUND OF THE INVENTION

The present invention is directed to compressors for cryogenic air separation. In particular, the present invention is directed to a combined service integrally geared compressor for cryogenic air separation.

Cryogenic oxygen production facilities initially produced oxygen at near atmospheric pressure and used inline centrifugal compressors or reciprocating piston compressors to compress the gas to the required pressure. Low cost, high pressure oxygen production facilities have been developed as liquid pumped plants. In these facilities, a liquid oxygen stream is pumped to the required pressure and vaporized against a stream of high pressure air. The high pressure air is typically compressed using either a separate air booster compressor or where a booster compressor service is combined with that of the air separation unit feed air compressor with an atmospheric suction as part of a multi service compressor. This approach has historically been the low cost approach primarily because the of high cost of oxygen compression and the need for a safety barrier, when compared to the cost of air booster stages and a liquid oxygen pump. Combined service integrally geared compressors are quite common in the industry where main air compression services and dry air compression and/or nitrogen compression services have been combined on one gear box. Cost and power savings can be significant when comparing a low pressure gaseous oxygen plant over a liquid pump plant. In a low pressure gaseous oxygen plant, the gaseous oxygen comes off of a low pressure column in the plant as a gas and is compressed to less than 50 psig. In a liquid pump plant, the presence of freezable materials must be addressed where factors may include, at a minimum, the cost of additional design reviews to the significant expense of the addition of hardware to reduce or eliminate the impact of impurities (larger front end clean up system, guard adsorbers or boiling liquid oxygen in a separate vessel).

Process plant compressors are typically radial compressors having a large diameter bull gear with meshing pinions upon the ends of which compression impellers are mounted. The multiple impellers within their own respective housings provide several stages of compression as desired. The bull gear and its meshing pinons are contained within a common housing. Consequently such compressors are known as integral gear compressors. The pinions may have differing diameters to best match the speed requirements of the compression impellers they drive. The compressed air between any two stages may be ducted to an intercooler, wherein it is cooled, thereby providing a more efficient compression process.

Some concepts are known where two or more compression duties are combined on a single compressor. For example, U.S. Pat. No. 5,901,579 (Mahoney et al.) discloses a compressor where the main air compression duty is combined on one machine with two compression wheels that share the air coming off of the main air compressor and compresses those streams to feed an air separation plant.

European Patent Application No. EP 0 672 877 A1 describes a machine that combines one or more high pressure air booster stages with one or more cryogenic expander all coup led to a gear box which is in turn coupled to a motor generator.

Air Products and Chemicals, Inc., Research Disclosure 40380, entitled "Integrated Air Booster and Oxygen Compression for Partial Pumped LOX Cyrogenic Air Separation Process Cycle," published in November of 1997, describes a machine that combines elevated suction dry air booster stages with oxygen compression stages.

Air Products and Chemicals, Inc., Research Disclosure 41763, entitled "Oxygen Enrichment of Air: Process Developments and Economic Trends," published in January of 1999, teaches numerous methods to increase the oxygen concentration based on a cryogenic process to produce a rich oxygen stream. Among other things, a pumped liquid oxygen process is taught where an air compressor is coupled to a boost compressor which are separate units whose shafts are connected to allow a single driver for the process.

U.S. Pat. No. 5,402,631 (Wulf) and U.S. Pat. No. 5,485,719 (Wulf) teach a system for supplying compressed air to a process plant using a combustor-turbine unit directly coupled to a bull gear meshing with pinions on which are mounted gas compression and expansion stages. Some stages compress a stream of air supplied to the combustor-turbine unit for combustion and to the process plant. Other stages expand or compress other gas streams directed to the combustor-turbine unit or to external applications.

U.S. Pat. No. 5,924,307 (Nenov) teaches a compressor assembly for cryogenic gas separation wherein the assembly comprises a compressor, an expansion turbine, and an electric motor integrally connected via a gear drive. This patent teaches a combination of a cryogenic turbine with an electric motor/generator and a compressor stage (or stages) in one device, with a gear case, to provide optimal operation of both the cryogenic turbine and the compressor.

However, none of these patents teaches a combined service integrally geared compressor for cryogenic air separation where the compressor is integrated with the air separation unit processes to obtain an overall cost and power benefit.

The object of the invention is to lower plant costs by taking advantage of recent changes that have taken place in the compression industry and by taking advantage of the acceptance of integrally geared compressors in oxygen service. The concept is to integrate the compressor with air separation unit cycles to obtain an overall cost and power benefit. These benefits can be magnified if coproducts are taken from the air separation unit. Cost reduction comes with developments that have lowered the cost of oxygen compression through the use of integrally geared compression and the simplification in plant design that naturally results from the use of direct oxygen compression as opposed to liquid pumping. Further benefits are identified when using this concept in conjunction with air separation units that use static liquid oxygen head to pressurize a stream of oxygen prior to the compression stage.

It is principally desired to provide a combined main air/$O_2$ enriched product compressor that overcomes the limitations of the prior art.

It is further desired to provide a combined main air/$O_2$ enriched product compressor that is highly efficient.

It is still further desired to provide a combined main air/$O_2$ enriched product compressor that allows for a simple design.

It is further desired to provide a combined main air/$O_2$ enriched product compressor where there is no requirement for a separate pump and all of its controls, piping and instrumentation.

It is still further desired to provide a combined main air/$O_2$ enriched product compressor where there is no requirement for air booster stages.

It is also desired to provide a combined main air/$O_2$ enriched product compressor where there is allowance for a possible reduction in heat exchanger cost.

It is further desired to provide a combined main air/$O_2$ enriched product compressor that provides improved oxygen recovery.

It is still further desired to provide a combined main air/$O_2$ enriched product compressor that provides decreased specific power where less energy is required to recover a unit amount of $O_2$ enriched gas.

Finally, it is desired to provide a combined main air/$O_2$ enriched product compressor which provides lower plant costs and power consumption by reducing the scope of, or by eliminating entirely, equipment associated with the removal of trace contaminants, (guard adsorbers, larger TSA systems, external vaporization pots), which promote the build up of hydrocarbons in the air separation unit.

BRIEF SUMMARY OF THE INVENTION

A combined main air/$O_2$ enriched product compressor for use with an air separation unit that produces $O_2$ enriched product where the concentration of $O_2$ is greater than air is provided that includes a prime mover that drives a bull gear. The bull gear drives at least two pinion gears, and the pinion gears drive several compression stages where at least one compression stage compresses feed air for the air separation unit and at least one compressor stage compresses $O_2$ enriched product gas from the air separation unit. The combined main air/$O_2$ enriched product compressor satisfies all air separation unit feed air requirements and at least some compression for the $O_2$ enriched product gas from the air separation unit.

At least one compressor stage that compresses the $O_2$ enriched product gas preferably compresses the $O_2$ enriched product gas to no more than about 50 psig.

The compressor includes a feed section to draw in atmospheric air to be compressed in the compressor.

The compressor preferably compresses the atmospheric air to between 60 and 200 psia.

The pressure of the $O_2$ enriched product gas provided by the air separation unit is preferably ½ to ⅙ the feed air pressure to the air separation unit.

A method for operating a cryogenic air separation unit is also provided, which includes the steps of providing a combined main air/$O_2$ enriched product compressor for use with the air separation unit that produces $O_2$ enriched product, where the product compressor includes a prime mover, a bull gear and at least two pinion gears. The steps further include driving the bull gear using the prime mover, driving at least two pinion gears with the bull gear, and driving a plurality of compressor stages with the pinion gears where at least one compression stage compresses feed air for the air separation unit and at least one compressor stage compresses $O_2$ enriched product gas from the air separation unit. Again, the combined main air/$O_2$ enriched product compressor satisfies all air separation unit feed air requirements and at least some compression for the $O_2$ enriched product gas from the air separation unit.

Preferably, in the method, the step including compressing $O_2$ enriched product gas from the air separation unit includes compressing the $O_2$ enriched product gas to no more than about 50 psig.

Preferably, the step of providing the compressor includes providing a compressor feed section to draw in atmospheric air to be compressed in the compressor.

The step of compressing the atmospheric air preferably includes compressing the atmospheric air to between 60 and 200 psia.

The step including compressing $O_2$ enriched product gas from the air separation unit preferably includes compressing the $O_2$ enriched product gas to 1.2 to 7 times greater than the feed air pressure to the air separation unit.

DETAILED DESCRIPTION OF THE INVENTION

Figure 1:
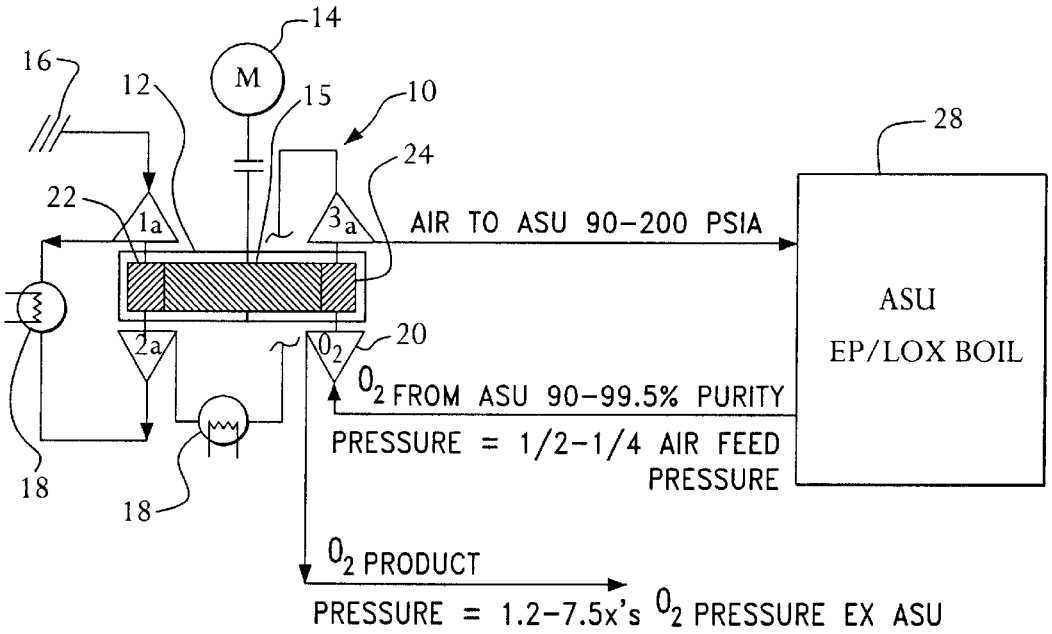
FIG. 1 is a schematic diagram of a combined main air/$O_2$ enriched product compressor in accordance with one preferred embodiment of the present invention.

Referring now to the drawings, there is shown in FIG. 1, a combined main air/$O_2$ enriched product compressor 10 in accordance with one preferred embodiment of the present invention. The present invention is directed to an integrally geared compressor 10 which combines feed air service and the product oxygen service as part of an air separation plant to produce gaseous $O_2$ enriched product at an elevated pressure. Both compression services are mounted on a single gearbox 12 and driven by a common driver in the form of prime mover such as an electric motor 14 that drives bull gear 15. Therefore, a single machine will satisfy all air separation unit (ASU) compression requirements within the limits of the machine.

In operation, atmospheric air is drawn into the feed air section of the compressor through air filter 16 and compressed to between 90 and 200 psia in one or more stages of compression, for example, stages 1*a*, 2*a*, and 3*a* as shown in FIG. 1, by pinions 22, 24 driven by bull gear 15. The atmospheric air is then fed to the air separation unit 28 for contaminant removal and processing. $O_2$ enriched product is drawn off of a low pressure column as a gas and sent to an $O_2$ enriched product compression stage 20 which pressurizes the gas for final use. In this instance, the ratio of feed air pressure to the air separation unit 28 to $O_2$ enriched product pressure from the air separation unit 28 is greater than two and less than four, where the $O_2$ enriched product purity is between 90 and 99.5%. Intercoolers 18, as known in the art, may be used to cool the air between stages to increase efficiency.

In the preceding example, the $O_2$ concentration was shown to be between 90 and 99.5%. This was shown as such as an example. While less common, it is intended that gas streams with $O_2$ concentrations higher than that of air are within the scope of the present invention.

Figure 2:
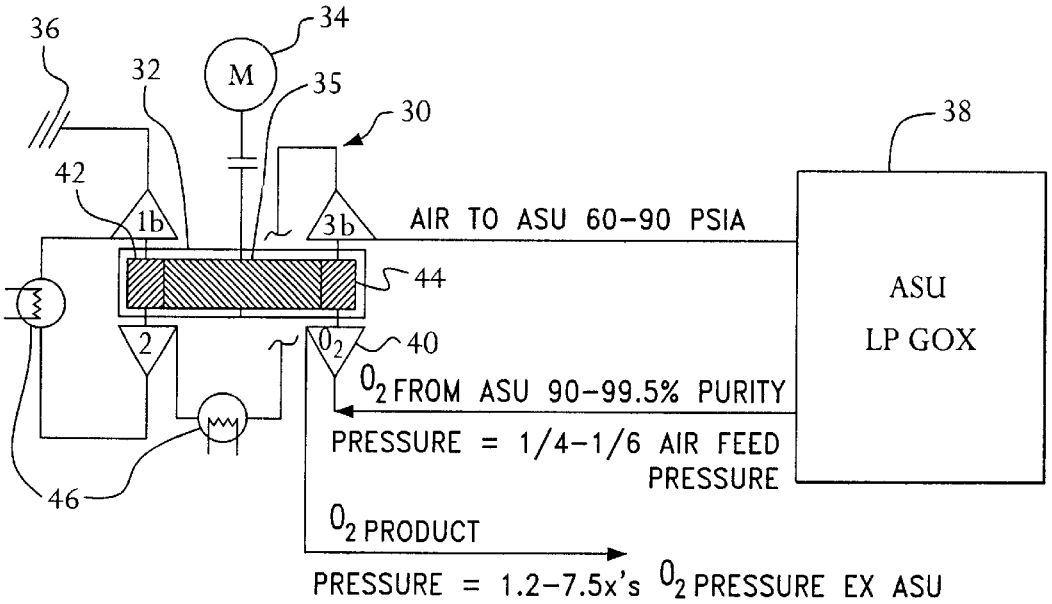
FIG. 2 is a schematic diagram of a combined main air/$O_2$ enriched product compressor in accordance with an alternate preferred embodiment of the present invention.

Another preferred embodiment is depicted in FIG. 2 which shows an alternate embodiment of the combined main air/$O_2$ enriched product compressor 30 in accordance with the present invention. Here, again, an integrally geared compressor 30 combines feed air service and the $O_2$ enriched product service as part of an air separation plant to produce gaseous $O_2$ enriched product at an elevated pressure. Both compression services are mounted on a single gearbox 32 and driven by a common driver 34. Therefore, a single machine will satisfy all air separation unit compression requirements within the limits of the machine.

In operation, atmospheric air is drawn into the feed air section of the compressor through air filter 36 and compressed to between 60 and 90 psia in one or more stages of compression, for example, stages 1*b*, 2*b*, and 3*b* as shown in FIG. 2, by pinions 42, 44 driven by bull gear 35. The atmospheric air is then fed to the air separation unit 38 for contaminant removal and processing. $O_2$ enriched product is drawn off of a low pressure column as a gas and sent to an $O_2$ enriched product compression stage 40 which pressurizes the gas for final use. In this instance, the ratio of feed air pressure to the air separation unit 38 to $O_2$ enriched product pressure from the air separation unit 38 is greater than four and less than six, where the $O_2$ enriched product purity is between 90 and 99.5%. Again, intercoolers 46, as known in the art, may be used to cool the air between stages to increase efficiency.

The embodiments of FIGS. 1 and 2 would, in cases where the final $O_2$ enriched product pressure is less than 50 psig, lower plant costs and power consumption by reducing the scope of or eliminating entirely, equipment associated with the removal of trace contaminants, (guard adsorbers, larger TSA systems, external vaporization pots), which promote the build-up of hydrocarbons in the air separation unit.

Applying this concept has several advantages over the current state of the art. In cases where an air separation unit producing $O_2$ enriched product at or near atmospheric pressure (e.g. an 1 p gaseous oxygen cycle) with a separate $O_2$ enriched product compressor to pressurize the $O_2$ enriched product is compared, the present embodiments result in lower overall cost by eliminating the need for a separate compressor with a dedicated driver, oil lubrication system, electrical controls and protection, and a foundation. An example of this configuration with respect to the present invention is depicted in FIG. 2. This concept could also be used in place of a scheme where static head is used to pressurize the $O_2$ enriched product stream.

Another application for this concept is in a cycle in which the oxygen product is pressurized as a liquid by pumping and is then vaporized against a stream of high pressure air. That air stream can be the entire air stream of which approximately 25% condenses in the main exchanger against the exiting oxygen product stream and the stream enters the high pressure column as a two phase fluid, or where approximately 25% of the total feed air is split off and totally condensed against the exiting oxygen stream. In the case where liquid oxygen is pumped to an elevated pressure (pumped lox), the integrated oxygen compressor concept would allow the elimination of an air booster stage (integrated or on a separate machine), and liquid pump stages. An example of this configuration is depicted in FIG. 1.

Another application would be to produce $O_2$ enriched product at an elevated pressure by taking advantage of the static head of liquid between the air separation unit low pressure column sump and grade (lox boil). The compression concept would extend the range where this feature is applied. By taking the statically pressurized $O_2$ enriched product and compressing it further, this cycle can be used for applications that normally would require a liquid oxygen pump and a high pressure air booster compressor or a separate oxygen compressor to attain the pressure needed.

Figure 3:
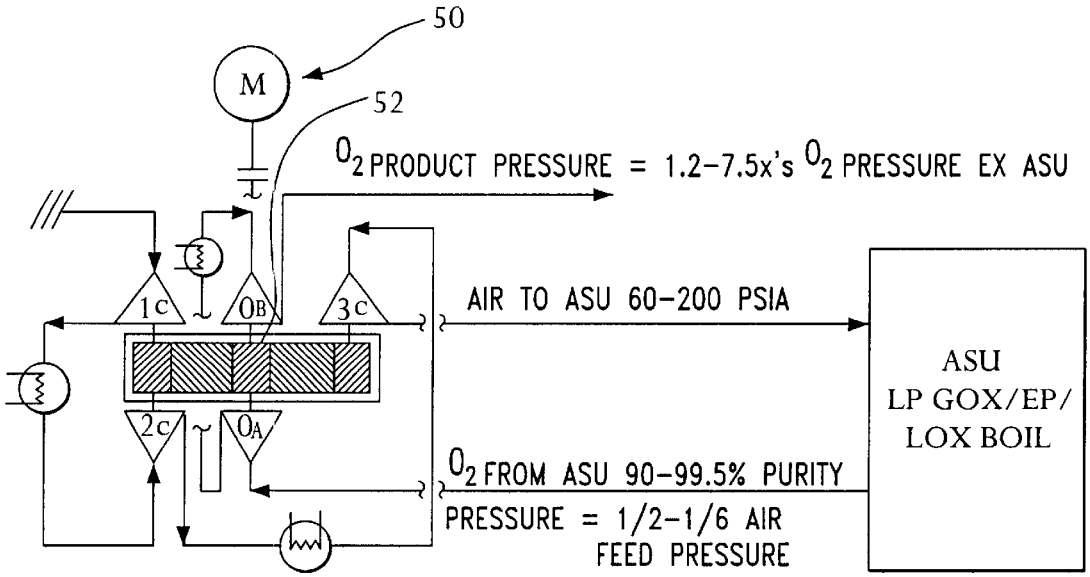
FIG. 3 is a schematic diagram of a combined main air/$O_2$ enriched product compressor in accordance with a second alternate preferred embodiment of the present invention.

In another alternate embodiment of the present invention as shown in FIG. 3, there is depicted a compressor 50 that can be used in place of the combined main air/$O_2$ enriched product compressors 10 and 30 shown in FIGS. 1 and 2. While the main air compressor 50 is similar to that of the embodiments of FIGS. 1 and 2, the $O_2$ enriched product service is shown as two stages of compression $O_A$, $O_B$ on a separate pinion 52. The combined main air $O_2$ enriched product compressors shown in FIGS. 1, 2, and 3 are examples of this concept where the main air compression section will always be two or more stages and the $O_2$ enriched product compression service will always be one or more stages, sharing a pinion with a latter stage of the air compression section or on a separate pinion.

All three embodiments as illustrated in FIGS. 1, 2 and 3 are shown with a single drive gear transmitting power to each pinion, a design which incorporates a drive gear and an idler gear to achieve an efficient speed match or to enable a certain mechanical configuration is a further enhancement of this scheme.

Compared to a process where oxygen is pressurized using a pump and vaporized against a high pressure air stream, the present invention has several advantages which include no requirement for a pump and all of its controls, piping and instrumentation, no requirement for air booster stages, and allowance for a possible reduction in heat exchanger cost.

Compared to a process in which the oxygen is pumped to the required pressure and vaporized against a stream of high pressure air, the embodiments of the present invention could be used to further compress a stream of pumped and vaporized oxygen that is below the required pressure, thereby lowering pump cost and power, heat exchanger costs, air booster compressor cost and energy consumption and improve overall cycle efficiency. It can also be used to provide oxygen at pressures higher than heat exchanger mechanical limits would allow.

This concept integrates air separation unit cycles with a multi service compressor which lowers overall plant costs, power consumption and simplifies the process. It differs from previous art in that the full wet air stream is compressed from atmospheric pressure, it combines feed air and $O_2$ product supply and there would be a need for only one machine per air separation unit. The prior art combines a pressurized dry air stream with oxygen compression which require additional machinery to compress the feed air and remove contaminants from it. The prior art does not have any affect on the sensitivity of the air separation unit to trace contaminant build up and was intended for use where heat exchanger mechanical limits precluded pumping to the pressure required. This concept is intended for lower pressure applications where heat exchanger mechanical limits are not an issue and can have an impact on whether of not equipment for the removal of trace contaminants is required.

Although illustrated and described herein with reference to specific embodiments, the present invention nevertheless is not intended to be limited to the details shown. Rather, various modifications may be made in the details within the scope and range of equivalents of the claims without departing from the spirit of the. invention.

We claim:

1. A combined main air/$O_2$ enriched product compressor for use with an air separation unit that produces $O_2$ enriched product, comprising a prime mover adapted to drive a bull gear, said bull gear adapted to drive at least two pinion gears, said pinion gears adapted to drive a plurality of compression stages, at least one compression stage adapted to compress feed air for the air separation unit to a feed air pressure and at least one compressor stage adapted to compress $O_2$ enriched product from said air separation unit to 1.2 to 7.5 times greater than the feed air pressure to the air separation unit, whereby said combined main air/$O_2$ enriched product compressor is adapted to satisfy all air separation unit feed air requirements and at least some compression for the $O_2$ enriched product from said air separation unit.

2. The combined main air/$O_2$ enriched product compressor of claim 1, wherein said remaining compressor stages adapted to compress said $O_2$ enriched product are adapted to compress said $O_2$ enriched product to no more than about 50 psig.

3. The combined main air/$O_2$ enriched product compressor of claim 1, wherein the compressor includes a feed section adapted to draw in atmospheric air to be compressed in the compressor.

4. The combined main air/$O_2$ enriched product compressor of claim 3, wherein the compressor compresses the atmospheric air to between 60 and 200 psia.

5. The combined main air/$O_2$ enriched product compressor of claim 3, wherein the compressor compresses the atmospheric air to between 90 and 200 psia.

6. The combined main air/$O_2$ enriched product compressor of claim 3, wherein the compressor compresses the atmospheric air to between 60 and 90 psia.

7. The combined main air/$O_2$ enriched product compressor of claim 1, wherein said at least one compressor stage adapted to compress $O_2$ enriched product from said air separation unit is adapted to compress $O_2$ enriched product to pressures higher than heat exchanger mechanical limits allow.

8. A method for operating a cryogenic air separation unit that produces $O_2$ enriched product, comprising the steps of:

(a) providing a combined main air/$O_2$ enriched product compressor for use with the air separation unit, said product compressor comprising a prime mover, a bull gear, at least two pinion gears, and a compressor feed section to draw in atmospheric air to be compressed in the compressor;

(b) driving said bull gear using said prime mover;

(c) driving said at least two pinion gears with said bull gear; and (d) driving a plurality of compressor stages with said pinion gears, at least one compression stage compressing feed air for the air separation unit to a feed air pressure, and at least one compressor stage compressing $O_2$ enriched product from said air separation unit, to 1.2 to 7.5 times greater than the feed air pressure to the air separation unit;

whereby said combined main air/$O_2$ enriched product compressor satisfies all air separation unit feed air requirements and at least some compression for the $O_2$ enriched product from said air separation unit.

9. The method for operating a cryogenic air separation unit of claim 7, wherein said step including compressing $O_2$ enriched product from said air separation unit includes compressing said oxygen product to no more than about 50 psig.

10. The method for operating a cryogenic air separation unit of claim 9, including the step of compressing the atmospheric air to between 60 and 200 psia.

11. The method for operating a cryogenic air separation unit of claim 9, including the step of compressing the atmospheric air to between 90 and 200 psia.

12. The method for operating a cryogenic air separation unit claim 9, including the step of compressing the atmospheric air to between 60 and 90 psia.

* * * * *

UNITED STATES PATENT AND TRADEMARK OFFICE

CERTIFICATE OF CORRECTION

PATENT NO. : 6,393,865 B1
DATED : May 28, 2002
INVENTOR(S) : Coakley et al.

It is certified that error appears in the above-identified patent and that said Letters Patent is hereby corrected as shown below:

Column 8,
Line 22, delete "7" and substitute therefor -- 8 --

Signed and Sealed this

Twenty-fourth Day of September, 2002

*Attest:*

*Attesting Officer*

JAMES E. ROGAN
*Director of the United States Patent and Trademark Office*